US005301391A

United States Patent [19]

Barauke

[11] Patent Number: 5,301,391

[45] Date of Patent: Apr. 12, 1994

[54] DRAFTING ROLLER SLEEVE WITH DRIVE ENGAGING/DISENGAGING LEVER

[75] Inventor: Norbert Barauke, Donzdorf, Fed. Rep. of Germany

[73] Assignee: Spindelfabrik Sussen, Schurr, Stahlecker & Grill GmbH, Fed. Rep. of Germany

[21] Appl. No.: 972,650

[22] Filed: Nov. 6, 1992

[30] Foreign Application Priority Data

Nov. 16, 1991 [DE] Fed. Rep. of Germany ..... 4137800

[51] Int. Cl.[5] ..... D01H 05/80

[52] U.S. Cl. ..... 19/293

[58] Field of Search ..... 19/236, 239, 256, 259, 19/260, 266, 267; 188/67, 827, 82.74, 82.77; 74/190, 325, 750; 192/32, 33 R, 34

[56] References Cited

U.S. PATENT DOCUMENTS 2,233,819 3/1941 Openshaw ..... 19/293 X
2,911,782 11/1959 Jackson et al. ..... 19/293 X
2,976,959 3/1961 Husted ..... 188/82.7
3,102,620 9/1963 Peddinghaus et al. ..... 192/33 R X

FOREIGN PATENT DOCUMENTS 0531051 10/1954 Belgium ..... 19/293
3920682 1/1991 Fed. Rep. of Germany .
0007782 of 1910 United Kingdom ..... 19/236
0682798 11/1952 United Kingdom ..... 19/293
0822355 10/1959 United Kingdom ..... 19/293

*Primary Examiner*—Clifford D. Crowder
*Assistant Examiner*—Ismael Izaguirre
*Attorney, Agent, or Firm*—Evenson, McKeown, Edwards & Lenahan

[57] ABSTRACT

In the case of a drafting unit for a spinning machine comprising several drivable bottom rollers, it is provided that the feeding bottom roller is constructed as a sleeve which can be connected with a drive shaft by coupling devices. The coupling devices comprise a swivelling lever which can be applied radially to the drive shaft and which engages in a catch of the drive shaft. The swivel shaft of the swivelling lever is arranged on the sleeve.

22 Claims, 1 Drawing Sheet

DRAFTING ROLLER SLEEVE WITH DRIVE ENGAGING/DISENGAGING LEVER

BACKGROUND AND SUMMARY OF THE INVENTION

This invention relates to a drafting unit for a spinning machine comprising several drivable bottom rollers, of which the feeding bottom roller is constructed as a sleeve which can be connected with a drive shaft by means of coupling devices.

In the case of a drafting unit of this type (German Patent Document DE 39 20 682 A1), a friction coupling is arranged between the sleeve and the drive shaft in the case of the feeding bottom roller, which friction coupling comprises two rings which are non-rotatably connected with the drive shaft, are arranged at a distance from one another and form friction areas with the opposite inner surfaces of the sleeve. Because of the draft between the feeding roller pair of the drafting unit and the roller pair which follows, the sliver to be drafted exercises a tensile force on the feeding bottom roller which results in a torque of the feeding bottom roller in the rotating direction of the drive shaft. An additional idle running device provides that this torque will not have the result that the sleeve rotates faster than the drive shaft. Because the sleeve is taken along by the sliver to be drafted, the take-along moment to be applied by the friction coupling only needs to reach a minimal value.

When the sleeve is stopped by means of a stopping element, for example, in the case of a yarn breakage, the drive shaft may continue to rotate while overcoming the frictional force of the friction coupling.

In the case of this known construction, there is the risk that the sleeve may rotate more slowly than the drive shaft which leads to faulty drafts in the drafting unit.

It is an object of the invention to develop a drafting unit of the initially mentioned type in such a manner that, while the drive shaft continues to rotate, the feeding bottom roller can be stopped individually, in which case a defined driving torque is ensured.

This object is achieved in that the coupling devices comprise a swivelling lever which can be applied radially to the drive shaft, engages in a catch of the drive shaft and whose swivel shaft is arranged on the sleeve.

In the case of this development, a form-locking coupling exists between the swivelling lever arranged on the sleeve and the drive shaft so that the sleeve rotates at exactly the same rotational speed as the drive shaft. After an uncoupling of the sleeve from its drive shaft by the disengagement of the swivelling lever from the catch of the drive shaft, the sleeve can be stopped individually although the drive shaft continues to rotate.

Advantageously, the swivel shaft is arranged in parallel to the axis of the drive shaft so that little space is required in the axial direction of the feeding. bottom roller for the swivel movement of the swivelling lever.

The swivelling lever is expediently arranged in the area of an end face of the sleeve. As a result, the coupling area can be separated constructionally from the bearing.

As a further development of the invention, a toothing is provided as a catch which is complementarily mounted on the swivelling lever as well as on the drive shaft. As a result, it is possible without difficulties to couple the stopped sleeve to the only slowly rotating drive shaft because a toothing ensures the play that is required for this purpose.

Advantageously, the toothing is provided on the drive shaft as an allround toothing. This accelerates the engaging operation because it is not necessary to wait until a catch moves by the area of the swivelling lever.

Advantageously, the axial course of the allround toothing corresponds to the width of the swivelling lever. This leads to a low constructional space requirement.

In an advantageous further development of the invention, the catch of the drive shaft is covered by the sleeve with the exception of the recess for the swivelling lever. As a result, the actual coupling part, apart from the swivelling lever that is visible from the outside, is situated in the interior of the sleeve so that any risk of injury is eliminated and any risk of contamination is minimized.

In a further development of the invention, the swivelling lever has two lever arms, of which one is assigned to the catch and the other is loaded by a spring in order to establish the coupling connection. This further development makes it possible to always press the swivelling lever against the catch of the drive shaft during the operation, in which case the springy devices can be mounted in the interior of the sleeve so that they are invisible from the outside.

It is advantageously provided that the moment of the spring which is effective with respect to the swivel shaft corresponds to the rotating direction of the drive shaft. In the case of such a development, the swivelling lever can be engaged in the catch of the drive shaft in a particularly smooth manner.

In a further development of the invention, it is provided that the swivelling lever is provided with a working surface situated outside the sleeve for a control element which disengages the sleeve. It is therefore possible, for example, in the event of a yarn breakage, to automatically stop the feeding bottom roller although the drive shaft continues to rotate. In this case, the working surface must be arranged such that the control element acts against the direction of the spring force.

Advantageously, the sleeve is disposed on the drive shaft by means of slide bearings. This results in a particularly narrow construction in the radial direction. In this case, it is expedient for the sleeve to be secured in the axial direction on the drive shaft by means of an elastic ring.

Other objects, advantages and novel features of the present invention will become apparent from the following detailed description of the invention when considered in conjunction with the accompanying drawings.

DETAILED DESCRIPTION OF THE DRAWINGS

Figure 1:
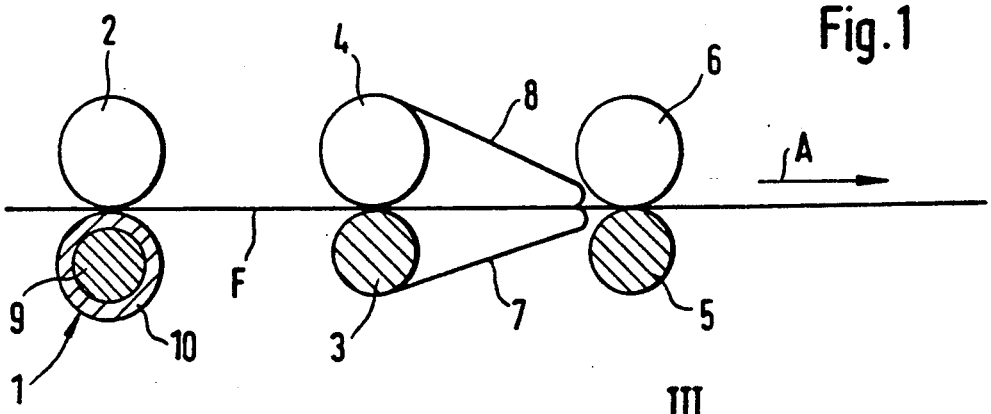
FIG. 1 is a schematic representation of a partially sectional lateral view of a drafting unit according to the invention.

FIG. 1 is a schematic representation of a drafting unit, as it is used as a so-called three-cylinder drafting unit in the case of spinning machines. On at least one side of the machine, the spinning machines have a plurality of such drafting units arranged next to one another in the longitudinal direction of the machine. Normally, these drafting units comprise additional parts which are not shown here because they are not important for explaining the invention.

Each drafting unit of the plurality of drafting units comprises three roller pairs 1 and 2, 3 and 4 as well as 5 and 6 through which a sliver F travels in the travelling direction A. The feeding roller pair 1, 2 receives the sliver F which is withdrawn from a feeding package or a sliver container. The roller pair 3, 4 rotates at an increased speed so that a drafting and drawing of the sliver F takes place in the drafting zone between feeding roller pair 1, 2 and roller pair 3, 4. The delivery roller pair 5, 6 rotates at a speed that is also increased with respect to roller pair 3, 4 so that, in the drafting zone between roller pair 3, 4 and delivery roller pair 5, 6, another drafting of the sliver F takes place until the desired yarn size is reached. As a rule, the main drafting, that is, the most extensive drafting of the sliver F, takes place in the drafting zone in front of the delivery roller pair 5, 6. In this main drafting zone, the sliver F is guided by means of guiding aprons 7 and 8 in a manner known per se.

The roller pairs 1 and 2, 3 and 4 as well as 5 and 6 each consist of a drivable bottom roller 1, 3, and 5 and a pertaining pressure roller 2, 4 and 6. In a manner that is not shown, the pressure rollers 2, 4 and 6 are held in a load carrier which presses the pressure rollers 2, 4 and 6 against the bottom rollers 1, 3 and 5 by means of an elastic prestressing force. Normally, the pressure rollers 2, 4 and 6 of adjacent spinning stations are combined to so-called pressure roller twins which are held in a common load carrier.

The bottom rollers 1, 3 and 5 are each driven by drive shafts which extend in the longitudinal direction of the machine and whose drive is situated on one end of the machine and drives the bottom rollers 1, 3 and 5 of all drafting units of the spinning stations of one side of the machine.

So that the continued transport of the sliver F in the drafting unit is interrupted in the case of an operational disturbance, such as a yarn breakage, it is provided that the feeding bottom roller 1 stops each drafting unit individually. For this purpose, each feeding bottom roller 1 is constructed as a sleeve 10 which can be connected with a drive shaft 9 by means of coupling devices.

Figure 2:
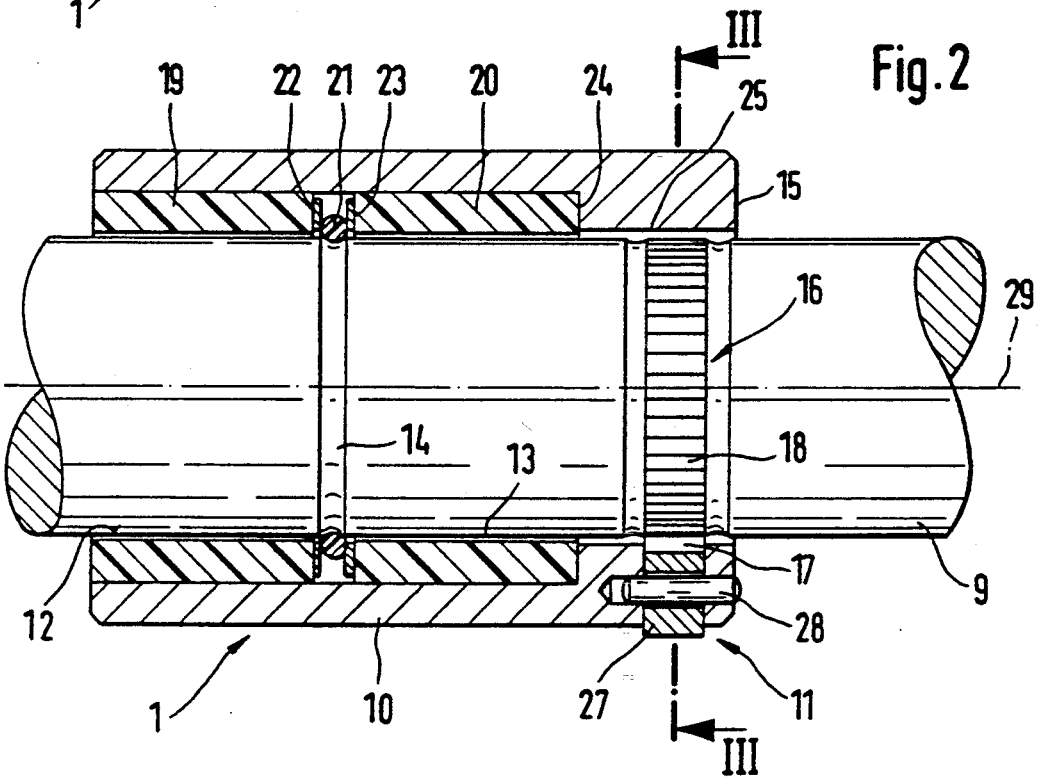
FIG. 2 is an axial sectional view of the feeding bottom roller of the drafting unit constructed according to the invention, according to FIG. 1.

The coupling devices, which together have the reference number 11, will be explained below by means of the enlarged FIGS. 2 and 3.

The drive shaft 9 assigned to the feeding bottom roller 1 has two bearing surfaces 12 and 13 in the area of the sleeve 10 which are separated from one another by means of a ring groove 14. In the area of one end face 15 of the sleeve 10, a catch 16 is mounted in the drive shaft 9 which has only a relatively narrow width and which, which the exception of a small recess 17 in the circumferential direction, is covered by the sleeve 10. The catch 16 on the drive shaft 9 consists of an allround toothing 18; that is, it extends virtually as a catch ring along the whole circumference. In a known manner, the drive shaft 9 is driven from the headstock of the spinning machine.

By means of two plastic rings 19 and 20, the pertaining sleeve 10 is slidably disposed on the bearing surfaces 12 and 13 of the drive shaft 9. In the axial direction, the plastic rings 1? and 20 are separated from one another by means of a slotted elastic ring 21. The ring 21 is situated in the ring groove 14 of the drive shaft 9 and can yield in the radial direction when the sleeve 10 is mounted so that the sleeve 10 can be slid onto the drive shaft 9 into its operating position and is axially secured at this point.

So that the slotted ring 21 will not strike directly against the plastic rings 19 and 20 and damage them, narrow spring steel disks 22 and 23 are in each case inserted between the ring 21 and the plastic rings 19 and 20. These spring steel disks 22 and 23 have play with respect to the drive shaft 9 as well as with respect to the interior circumferential surface of the sleeve 10.

On the side facing the catch 16, the plastic ring 20 situated between the ring groove 14 and the catch 16 is placed, by means of one end face 24, against a corresponding collar of the sleeve 10. The interior bore 25 of the sleeve 10 situated in the area of the catch 16 certain play with respect to the outer circumference of the catch 16.

The catch 16 has the purpose of coupling the sleeve 10 during the operation in a form-locking manner to the drive shaft 9 but, in the case of a disturbance, although the drive shaft 9 continues to rotate, to stop the sleeve 10 individually. This must be possible for each feeding bottom roller 1 of each drafting unit of each spinning station.

For the purpose of the coupling, a toothing 26 of the sleeve 10 is assigned to the allround toothing 18 of the catch 16. The toothing 26, which can form-lockingly engage in the allround toothing 18, is situated on a swivelling lever 27 whose swivel shaft 28 is arranged on the sleeve 10. In this case, the swivel shaft 28 is constructed as a split-pin which extends in parallel to the axis 29 of the drive shaft 9 and which is pushed into the sleeve 10 with a press fit. The swivelling lever 27 is disposed on this split-pin with play.

The swivelling lever 27, whose width corresponds to the width of the allround toothing 18, is constructed as a two-armed lever. One lever arm 30 carries the toothing 26 so that the catch 16 is mounted complementarily on the swivelling lever 27 as well as on the drive shaft 9. The second lever arm 31 is loaded by a pressure spring 32 which loads the end 34 of the lever arm 31 by way of a pin 33 and thus seeks to swivel the swivelling lever 27 corresponding to the direction of the arrow M about the swivel shaft 28. The pressure spring 32 therefore provides that the swivelling lever 27 engages in the catch 16 during the operation, thus in the coupled state.

Figure 3:
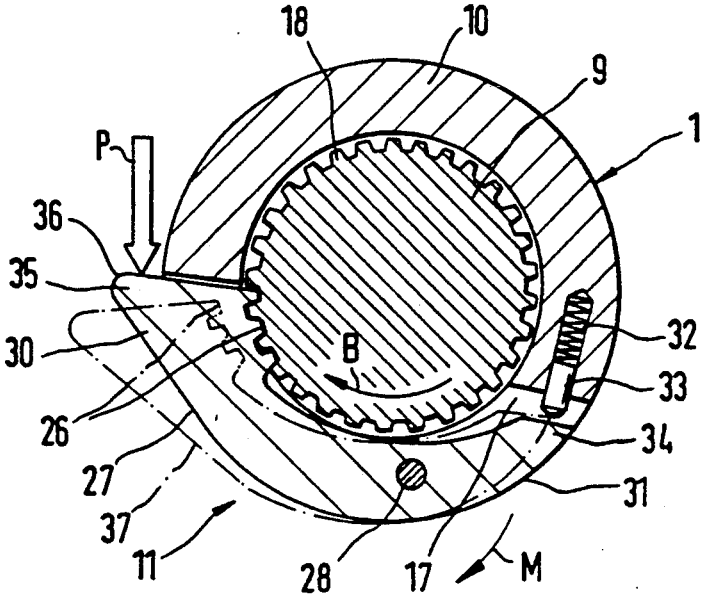
FIG. 3 is a sectional view along Line III—III of FIG. 2.

As indicated in FIG. 3, the pressure spring 32 and the pin 33 are arranged in the interior of the sleeve 10 so that only the swivelling lever 27 is visible from the outside. The swivelling lever 27 covers the catch 16 toward the outside in the area of the recess 17.

The moment of the pressure spring 32 acting in the direction of the arrow M corresponds to the rotating direction B of the drive shaft 9. This results in a particularly smooth engagement of swivelling lever 27, which is at first stopped with the sleeve 10, into the slowly rotating drive shaft 9. In this case, the toothing 26 of the swivelling lever 27 is applied radially to the allround toothing 18 of the drive shaft 9 and can be engaged at any time.

On the side of the lever arm 30, which carries the toothing 26, the swivelling lever 27 projects by means of a lengthening 35 out of the sleeve 10 toward the outside. As a result, a working surface 36 is created for a control element which in the manner of a symbol is shown by an arrow P. In a manner that is not shown, this control element may be coupled with a yarn detector or a sliver detector and, in the case of a disturbance, may press against the working surface 36 of the swivelling lever 27. As a result, the swivelling lever 27 is swivelled against the pressure of the pressure spring 32 about the swivel shaft 28, as illustrated in a dash-dotted manner by means of position 37. In this position 37, the swivelling lever 27 is disengaged from the catch 16 so that the sleeve 10 can be stopped despite the continuously rotating drive shaft 9.

The feeding bottom roller 1, which was described by means of the example of a three-cylinder drafting unit, can also be used for other drafting units, such as five-cylinder drafting units according to other contemplated embodiments. Furthermore, it is possible according to other contemplated embodiments to not only provide the feeding bottom roller 1 but several or all bottom rollers 3, 5 with such a coupling.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A drafting unit arrangement for a spinning machine comprising several drivable bottom rollers, said drafting unit arrangement including a feeding bottom roller constructed as a sleeve which is selectively drivingly connectable with a drive shaft by means of a coupling device, wherein the coupling device comprises a swivel shaft mounted on the sleeve, a swivelling lever mounted on the swivel shaft, a catch formed on the drive shaft, the swivelling lever radially applied and engaging or disengaging with the catch of the drive shaft for starting or stopping rotation of the sleeve.

2. A drafting unit arrangement according to claim 1, wherein the swivel shaft is mounted in parallel to the axis of the drive shaft.

3. A drafting unit arrangement according to claim, 2, wherein the swivelling lever is mounted on the swivel shaft in the area of an end face of the sleeve.

4. A drafting unit arrangement according to claim 3, wherein a toothing is provided as the catch and is mounted complementarily on the swivelling lever as well as on the drive shaft.

5. A drafting unit arrangement according to claim 4, wherein the toothing is mounted on the drive shaft as an allround toothing.

6. A drafting unit arrangement according to claim 5, wherein an axial course of the allround toothing corresponds to a width of the swivelling lever.

7. A drafting unit arrangement according to claim 6, wherein the catch of the drive shaft is covered by the sleeve with the exception of a recess of the sleeve for the swivelling lever.

8. A drafting unit arrangement according to claim 7, wherein the swivelling lever has two lever arms, of which one is assigned to the catch and the other is loaded by a spring in order to establish the coupled connection.

9. A drafting unit arrangement according to claim 8, wherein the moment of the spring which is effective with respect to the swivel shaft corresponds to the rotating direction of the drive shaft.

10. A drafting unit arrangement according to claim 9, wherein the swivelling lever is provided with a working surface which is situated outside the sleeve to allow interaction with a control element for disengaging the sleeve.

11. A drafting unit arrangement according to claim 10, wherein the sleeve is disposed on the drive shaft by means of slide bearings.

12. A drafting unit arrangement according to claim 11, wherein the sleeve is secured on the drive shaft, in the axial direction, by means of an elastic ring on the drive shaft.

13. A drafting unit arrangement according to claim 1, wherein the swivelling lever is mounted on the swivel shaft in the area of an end face of the sleeve.

14. A drafting unit arrangement according to claim 1, wherein a toothing is provided as the catch and is mounted complementarily on the swivelling lever as well as on the drive shaft.

15. A drafting unit arrangement according to claim 14, wherein the toothing is mounted on the drive shaft as an allround toothing.

16. A drafting unit arrangement according to claim 15, wherein an axial course of the allround toothing corresponds to a width of the swivelling lever.

17. A drafting unit arrangement according to claim 1, wherein the catch of the drive shaft is covered by the sleeve with the exception of a recess of the sleeve for the swivelling lever.

18. A drafting unit arrangement according to claim 1, wherein the swivelling lever has two lever arms, of which one is assigned to the catch and the other is loaded by a spring in order to establish the coupled connection.

19. A drafting unit arrangement according to claim 18, wherein the moment of the spring which is effective with respect to the swivel shaft corresponds to the rotating direction of the drive shaft.

20. A drafting unit arrangement according to claim 1, wherein the swivelling lever is provided with a working surface which is situated outside the sleeve to allow interaction with a control element for disengaging the sleeve.

21. A drafting unit arrangement according to claim 1, wherein the sleeve is disposed on the drive shaft by means of slide bearings.

22. A drafting unit arrangement according to claim 1, wherein the sleeve is secured on the drive shaft, in the axial direction, by means of an elastic ring on the drive shaft.

* * * * *